US008974608B2

(12) United States Patent
Hirose et al.

(10) Patent No.: US 8,974,608 B2
(45) **Date of Patent: *Mar. 10, 2015**

(54) POWDER MAGNETIC CORE AND THE METHOD OF MANUFACTURING THE SAME

(75) Inventors: Takayuki Hirose, Sagamihara (JP); Masaharu Edo, Tokorozawa (JP); Akira Sato, Matsumoto (JP)

(73) Assignee: Fuji Electric Co., Ltd., Kawasaki-shi (JP)

( * ) Notice: Subject to any disclaimer, the term of this patent is extended or adjusted under 35 U.S.C. 154(b) by 1750 days.

This patent is subject to a terminal disclaimer.

(21) Appl. No.: 12/081,490

(22) Filed: Apr. 16, 2008

(65) Prior Publication Data

US 2008/0258102 A1 Oct. 23, 2008

(30) Foreign Application Priority Data

Apr. 17, 2007 (JP) ..... 2007-108637

(51) Int. Cl.

| | |
|---|---|
| ***B22F 1/00*** | (2006.01) |
| ***H01F 1/00*** | (2006.01) |
| ***H01F 1/03*** | (2006.01) |
| ***C22C 1/00*** | (2006.01) |
| ***H01F 41/02*** | (2006.01) |
| ***B22F 1/02*** | (2006.01) |
| ***B22F 7/02*** | (2006.01) |
| ***C22C 33/02*** | (2006.01) |
| ***H01F 1/24*** | (2006.01) |

(52) U.S. Cl.

CPC ..... *H01F 41/0246* (2013.01); *B22F 1/02* (2013.01); *B22F 7/02* (2013.01); *C22C 33/0228* (2013.01); *H01F 1/24* (2013.01); *B22F 2998/10* (2013.01); *C22C 2202/02* (2013.01)

USPC ..... 148/104; 148/513; 148/120; 148/105; 148/101; 148/100; 148/95

(58) Field of Classification Search

None

See application file for complete search history.

(56) References Cited

U.S. PATENT DOCUMENTS

| | | | | |
|---|---|---|---|---|
| 5,183,631 | A | 2/1993 | Kugimiya et al. | |
| 2002/0039667 | A1 * | 4/2002 | Takaya et al. | 428/692 |
| 2004/0238796 | A1 | 12/2004 | Abe | |

FOREIGN PATENT DOCUMENTS

| | | | | |
|---|---|---|---|---|
| JP | 56-038402 | | 4/1981 | |
| JP | 04-021739 | A | 1/1992 | |
| JP | 09-074016 | | 3/1997 | |
| JP | 11-074140 | | 3/1999 | |
| JP | 2000-054083 | | 2/2000 | |
| JP | 2001-085211 | | 3/2001 | |
| JP | 2005-317679 | A | 11/2005 | |
| PL | EP 1564764 | * | 12/2004 | H01F 41/02 |
| WO | WO-03/015109 | | 2/2003 | |

* cited by examiner

*Primary Examiner* — Yoshitoshi Takeuchi
(74) *Attorney, Agent, or Firm* — Rabin & Berdo, P.C.

(57) ABSTRACT

A powder magnetic core with improved high frequency magnetic characteristics and reduced eddy current loss is manufactured by a manufacturing method including the steps of (a) providing coated soft magnetic particles which are particles composed of soft magnetic material which each have been coated with an insulating coating, and insulator particles; (b) forming a magnetic layer by press molding the coated soft magnetic particles in a mold assembly; (c) forming an insulator layer on the magnetic layer by press molding the insulator particles in the mold assembly; and (d) repeating the steps (b) and (c) to fabricate a laminate of alternating magnetic layers and insulator layers and provide the powder magnetic core.

13 Claims, 4 Drawing Sheets

POWDER MAGNETIC CORE AND THE METHOD OF MANUFACTURING THE SAME

CROSS-REFERENCE TO RELATED APPLICATION

This Application claims the benefit of the priority of Applicant's earlier filed Japanese Published Application 2007-108637 filed Apr. 17, 2007, the contents of which are incorporated herein by reference.

BACKGROUND OF THE INVENTION

1. Field of the Invention

The present invention relates to a powder magnetic core and to a manufacturing method for making the powder magnetic core. The powder magnetic core is used for a transformer or a reactor in a switching power supply.

2. Background of the Related Art

Recently, the sizes and weights of various electronic instruments have been reduced. In association with this trend, the switching power supplies mounted on the electronic instruments have been required to be reduced in size. There has been a particularly strong requirement to reduce the dimensions and thickness of the switching power supplies on notebook-type personal computers, small portable instruments, thin CRTs, flat panel displays and such instruments. However, the transformers, reactors and such main magnetic component parts of conventional switching power supplies occupy large spaces and this puts limits on efforts to reduce the dimensions and thicknesses of the conventional power supplies. Therefore, it is difficult to reduce the volume of the switching power supplies when the volume of transformers, reactors and such main magnetic component parts remain unreduced.

Metal magnetic materials, such as Sendust, Permalloy, and oxide magnetic materials such as ferrite, have been used for transformers, reactors and such main magnetic component parts in the switching power supplies. Although the metal magnetic materials exhibit a high saturation magnetic flux density and high magnetic permeability generally, the metal magnetic materials cause a large eddy current loss in a high frequency range due to the low electrical resistivity thereof. According to recent technical trends, the size of the magnetic component parts are reduced by lowering the relevant inductance values by means of driving the power supply circuits at a high frequency. However, the metal magnetic materials are still unemployable at a high frequency due to the adverse effects of eddy current loss.

The eddy current loss caused by oxide magnetic materials at a high frequency range is low due to the high electrical resistivity thereof. However, it has been impossible to reduce the volume of a component part made of the oxide magnetic material, since the oxide magnetic material is liable to saturate magnetically due the low saturation magnetic flux density thereof. In any case, the magnetic core volume is the most decisive factor that determines the inductance value. Therefore, it is difficult to reduce the dimensions and thicknesses of the magnetic component parts without working to improve the magnetic properties of the magnetic materials.

Since there exist certain limitations on down-sizing the conventional magnetic component parts as described above, the conventional magnetic component parts have been unable to meet the requirements of reducing the dimensions and thicknesses of electronic instruments.

For obviating the problems described above, a high-density sintered magnetic compact that includes metal magnetic particles, 1 to 10 μm in thickness and covered with a metal oxide magnetic material having a spinel composition described by M-$Fe_xO_4$ (here, M=Ni, Mn and Zn, $x \leq 2$), has been proposed (see Unexamined Japanese Patent Application Publication No. Sho. 56 (1981)-38402).

International Publication No. 03/015109 proposes a composite magnetic material formed by compression-molding ferromagnetic metal powders having small particle diameters or by compression-molding ferromagnetic intermetallic compound powders having small particle diameters. The ferromagnetic metal powders are covered with respective ferrite coating layers formed by ultrasonic-wave-excited ferrite plating. Magnetic paths are formed between the ferromagnetic metal powders through the ferrite coating layers. The ferromagnetic intermetallic compound powders are covered with respective ferrite coating layers formed by ultrasonic-wave-excited ferrite plating. Magnetic paths are formed between the ferromagnetic intermetallic compound powders through the ferrite coating layers.

In Unexamined Japanese Patent Application Publication No. 2001-85211, for obtaining a soft magnetic compact that exhibits a high density and high specific resistance, a soft magnetic particle including a soft magnetic metal particle, a very resistive material layer (hereinafter referred to as a "very resistive layer") covering the soft magnetic metal particle, and a chemically-formed phosphate coating film covering the very resistive layer are used.

Recently, a magnetic material for improving the resistivity, which is the weak point of the metal magnetic material, has been proposed. The magnetic material is formed by coating a nonmagnetic insulator oxide coating film (hereinafter referred to as a "nonmagnetic insulator coating") exhibiting a high electrical resistivity and covering a soft magnetic metal particle exhibiting a high saturation magnetic flux density and a high magnetic permeability. This magnetic material, which utilizes the favorable effects of the nonmagnetic insulator coating for improving the electrical resistivity thereof, facilitates suppressing the eddy current. In other words, the magnetic material can be used in the MHz band and such a high frequency range.

For further reducing the eddy current loss in the MHz band caused in the soft magnetic compact obtained by molding the magnetic material particles described above, it is necessary to thicken the nonmagnetic insulator coating or the very resistive layer formed on the metal particle in order to improve the resistivity of the soft magnetic compact. For example, the resistivity of the soft magnetic compact according to the prior art disclosed in Unexamined Japanese Patent Application Publication No. 2001-85211 and described in Table 3 thereof is improved as compared with that of the comparative example but still insufficiently. Unexamined Japanese Patent Application Publication No. 2001-85211 discloses the volume iron loss of the soft magnetic compact at a frequency as high as 10 kHz. For making the soft magnetic compact work at 1 MHz, it is necessary to further thicken the very resistive layer in order to raise the compact resistivity. However, thickening the nonmagnetic insulator coating or the very resistive layer widens the gap between the metal particles, lowering the magnetic permeability. If the magnetic permeability is improved by thinning the nonmagnetic insulator coating or by thermally treating the soft magnetic compact, formed by press molding, at an elevated temperature, the eddy current loss in the MHz band will increase due to the resistivity lowering.

For further reducing the eddy current loss in the MHz band, Unexamined Japanese Patent Application Publication No. Hei. 11 (1999)-74140 discloses a manufacturing method that thins the thickness of the powder magnetic cores formed by press molding and laminates the thin powder magnetic cores and insulator layers alternately.

Unexamined Japanese Patent Application Publication No. 2000-54083 and Unexamined Japanese Patent Application Publication No. Hei. 9 (1997)-74016 propose a method of manufacturing a multilayered soft magnetic compact that forms a soft magnetic laminate by laminating soft magnetic films and insulator films alternately.

The method disclosed in Unexamined Japanese Patent Application Publication No. Hei. 11 (1999)-74140 laminates two rings, each 5.5 mm in thickness, by hot pressing to form a laminate of 10 mm in thickness. If the total electronic part thickness is thinner than 0.6 mm, the thickness of the layer to be laminated inevitably will be thinner than half the total thickness, e.g., 0.2 mm or thinner. For securing a sufficient mechanical strength, it is difficult to form such a thin core by press molding. The difficulty increases especially with an increasing core area. Since the total thickness is thin, it is necessary for the laminating method, which laminates thin core layers and insulator layers alternately, to control the thickness of each insulator layer to be 0.05 μm or thinner. However, it is substantially difficult to manufacture such a thin core plate by press-molding.

Unexamined Japanese Patent Application Publication No. 2000-54083 and Unexamined Japanese Patent Application Publication No. Hei. 9 (1997)-74016 describe laminate structures, each including magnetic films and insulator films, used for an inductor or a transformer core. Since uniform magnetic layers for the laminate structures are formed by sputtering or by vacuum deposition, it takes a long time to obtain a laminate of 1 to 10 μm in thickness.

In view of the foregoing, it would be desirable to obviate the problems described above. Also, it would be desirable to provide a powder magnetic core that facilitates improving the high-frequency characteristics thereof and reducing the eddy current loss thereof. It would be further desirable to provide a method for manufacturing a laminate structure laminating thin core layers and insulator layers alternately for improving the high-frequency characteristics of the powder magnetic core and for reducing the eddy current loss thereof.

SUMMARY OF THE INVENTION

According to an aspect of the invention, there is provided a method of manufacturing a powder magnetic core, the method including the steps of:

(a) providing coated soft magnetic particles which are particles comprised of soft magnetic material which each have been coated with an insulating coating, and insulator particles;

(b) forming a magnetic layer by press molding the coated soft magnetic particles in a mold assembly;

(c) forming an insulator layer on the magnetic layer by press molding the insulator particles in the mold assembly; and (d) repeating the steps (b) and (c) to fabricate a laminate of alternating magnetic layers and insulator layers and provide the powder magnetic core.

The powder magnetic core according to the invention is manufactured by the method described above.

According to the invention, a laminate structure for a powder magnetic core including magnetic layers (hereinafter referred to sometimes as "core layers") and insulator layers is manufactured easily not by adhering thin core layers and thin insulator layers but by forming the constituent layers through press molding steps layer by layer. The laminate structure formed as described above facilitates improving the magnetic permeability in the high-frequency range and reducing the eddy current loss.

According to the invention, a soft magnetic particle covered with a thick insulator oxide coating film, thicker than the insulator oxide coating film covering the soft magnetic particle for forming a thin core layer, is used for forming an insulator layer. The soft magnetic particles in the insulator layer increase the total volume of the magnetic material as compared with using only a nonmagnetic insulator for the insulator layer. Therefore, the laminate structure for the powder magnetic core according to the invention is more advantageously improves the powder magnetic core magnetic properties.

BRIEF DESCRIPTION OF THE VARIOUS VIEWS OF THE DRAWING

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Figure 6:
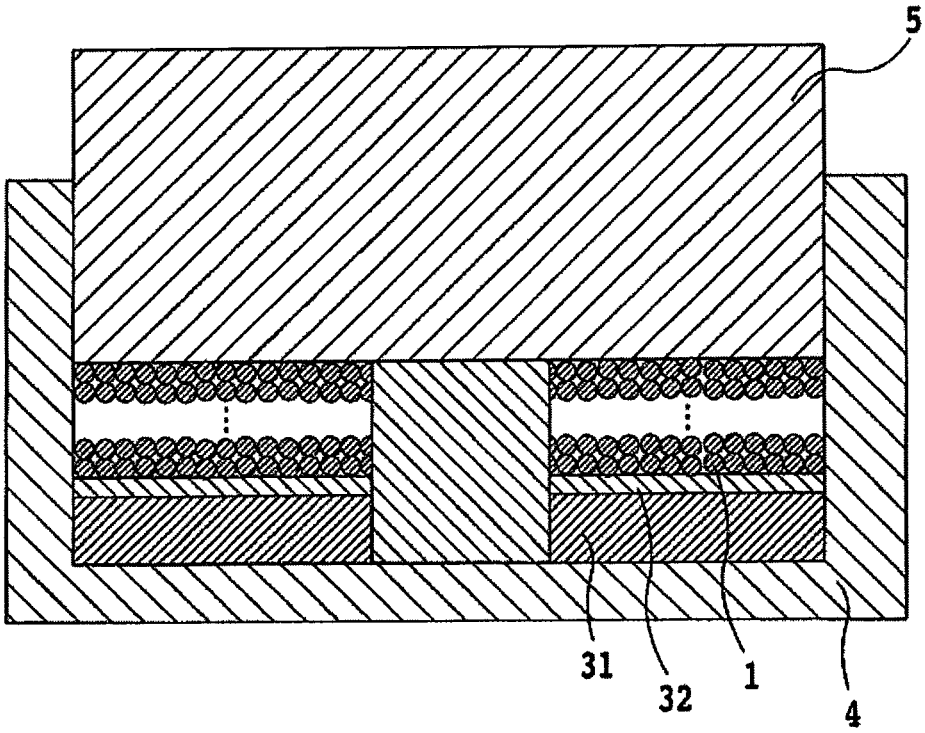
Figure 7:
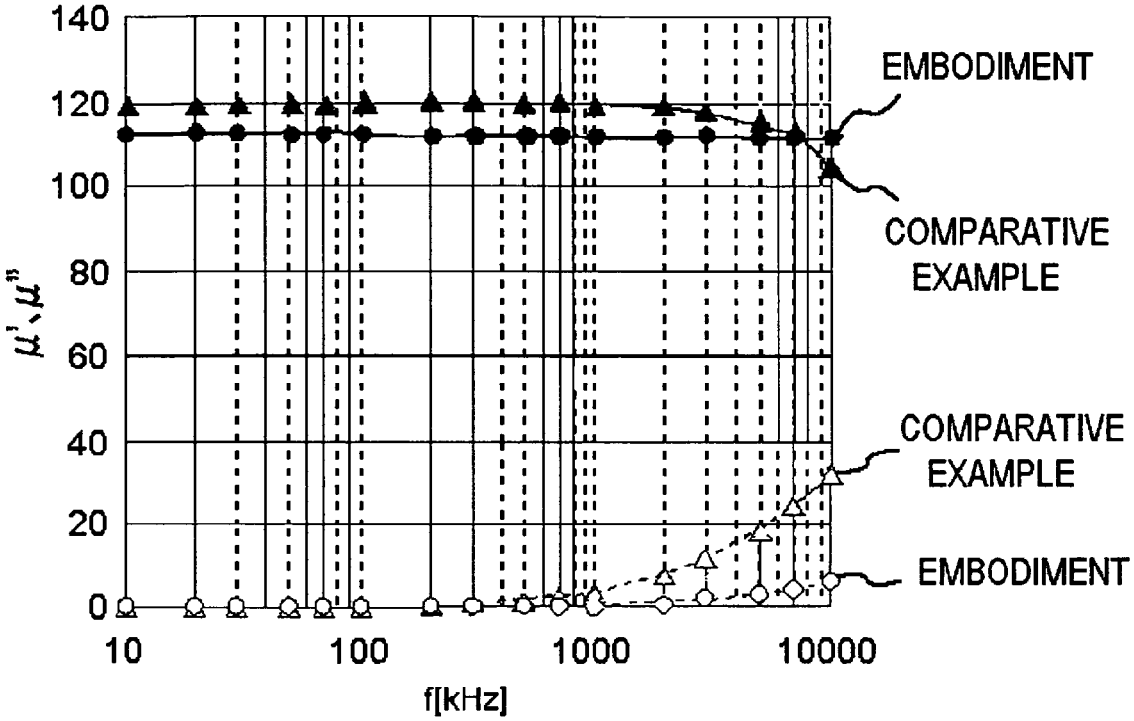

FIG. 6 is a cross sectional view schematically showing the mold assembly molding a magnetic second layer on the insulator first layer using soft magnetic metal particles, each covered with an insulator oxide coating film formed thereon; and FIG. 7 is a graph describing the frequency characteristics of the magnetic permeability μ' and the magnetic permeability μ" for the powder magnetic core according to a first embodiment of the invention and for the powder magnetic core according to a comparative example 1.

DETAILED DESCRIPTION OF THE INVENTION

Figure 1:
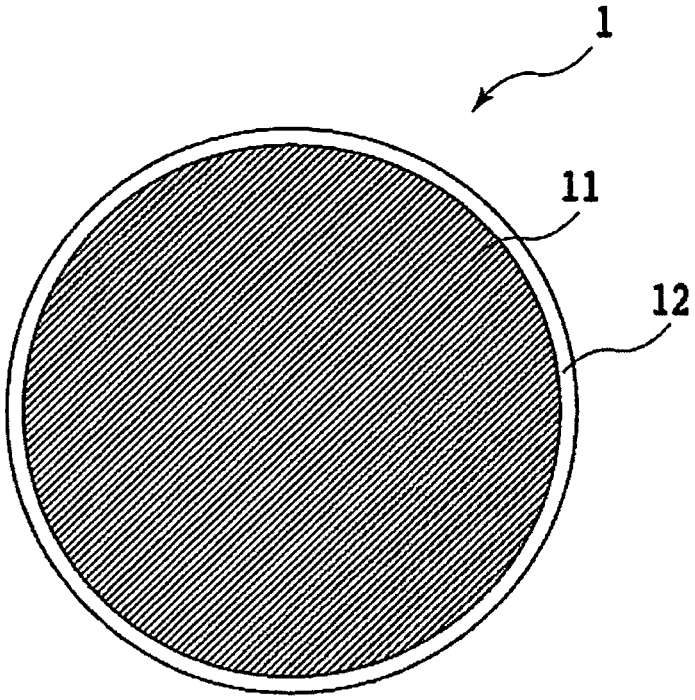
FIG. 1 is a cross sectional view schematically showing a soft magnetic metal particle covered with an insulator oxide coating film formed thereon and used for a magnetic layer.

The magnetic layer according to the invention is formed using soft magnetic metal particle 1 (hereinafter referred to simply as "particle 1"). Particle 1 includes soft magnetic metal particle 11 (hereafter referred to as "first soft magnetic particle 11") and insulator oxide coating film 12 (hereinafter referred to as "first insulator coating 12") covering first soft magnetic particle 11 as shown in FIG. 1.

The metal in particle 1 is selected from a metal group including iron, cobalt, nickel and such metals which exhibit a high magnetic permeability. The metal in particle 1 is selected also from an alloy group including Permalloy, Sendust and such alloys which contain iron, cobalt, nickel and such metals which exhibit a high magnetic permeability as a fundamental component thereof.

Preferably, the first soft magnetic particle 11 is 1 to 30 μm in diameter, although first soft magnetic particle 11 having a diameter outside the above-described range is employable.

Ferrite, iron-based oxides and such oxides which exhibit high electrical resistivity are used for first insulator coating 12 on first soft magnetic particle 11. Insulator oxides such as glass, silica and alumina are used also for first insulator coating 12 on first soft magnetic particle 11. Ferrite used for first insulator coating 12 includes Ni—Zn ferrite, Cu—Zn—Mg ferrite and a composite ferrite which contains Ni—Zn ferrite and/or Cu—Zn—Mg ferrite as the main component thereof. The glass used for first insulator coating 12 contains al least $SiO_2$, $B_2O_3$ or $P_2O_5$ as the main component thereof.

Although the thickness of first insulator coating 12 on first soft magnetic particle 11 is unlimited as long as first insulator coating 12 is thick enough to raise the electrical resistance between first soft magnetic particles 11, it is preferable for first insulator coating 12 to be 5 nm or more in thickness. It is more preferably for first insulator coating 12 to be 10 nm or more in thickness. For improving the magnetic permeability, it is preferable for first insulator coating 12 to be 50 nm or less in thickness. It is more preferably for first insulator coating 12 to be 30 nm or less in thickness.

Figure 2:
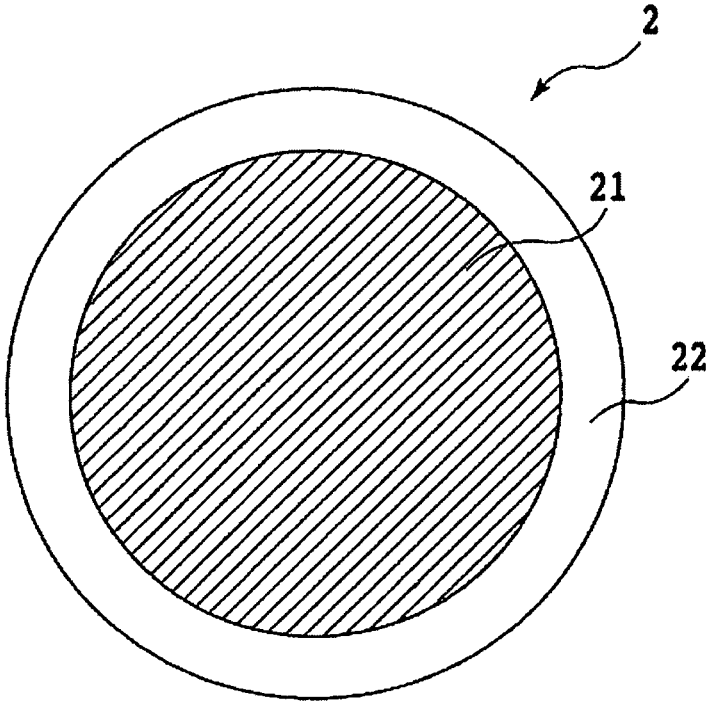
FIG. 2 is a cross sectional view schematically showing a soft magnetic metal particle covered with a thick insulator oxide coating film formed thereon and used for an insulator layer.

The oxides such as ferrite and iron-based oxides, and insulator oxides such as glass, silica and alumina are used for the insulator particle in the insulator layer. For obtaining a powder magnetic core that exhibits excellent magnetic properties, it is preferable to use insulated soft magnetic particle 2 (hereinafter referred to simply as "particle 2") that includes thick insulator oxide coating film 22 (hereinafter referred to as "thick insulator coating 22") on second soft magnetic metal particle 21 (hereinafter referred to as "second soft magnetic particle 21") as shown in FIG. 2.

For the soft magnetic metal in particle 2, covered with thick insulator coating 22, for forming the insulator layer, the soft magnetic metals such as those used for particle 1, covered with first insulator coating 12 for forming the magnetic layer are used. Ferrite, iron-based oxides and such oxides which exhibits high electrical resistivity are used for thick insulator coating 22 on second soft magnetic particle 21. Insulator oxide such as glass, silica and alumina are also used for thick insulator coating 22 on second soft magnetic particle 21. Ferrite used for thick insulator coating 22 includes Ni—Zn ferrite, Cu—Zn—Mg ferrite and a composite ferrite which contains Ni—Zn ferrite and/or Cu—Zn—Mg ferrite as the main component thereof. The glass used for thick insulator coating 22 contains at least $SiO_2$, $B_2O_3$ or $P_2O_5$ as the main component thereof.

Thick insulator coating 22 on second soft magnetic particle 21 in particle 2 is preferably 100 nm to 300 nm in thickness. An insulator coating film thinner than 100 nm as a lower limit causes insufficient insulation. An insulator coating film thicker than 300 nm as an upper limit, reduces the magnetic material ratio, further causing poor magnetic properties and an elongated time period for forming the coating film.

Figure 3:
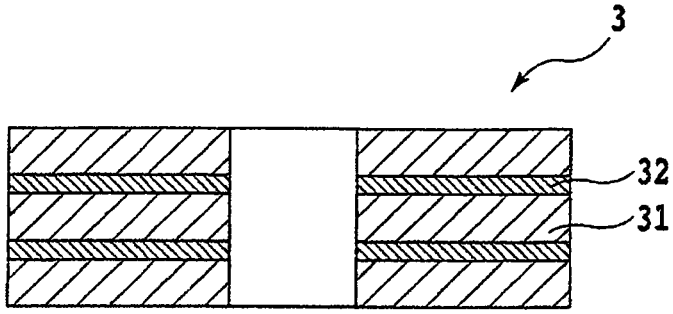
FIG. 3 is a cross sectional view schematically showing the laminate structure for a powder magnetic core according to a first embodiment of the invention.
Figure 4:
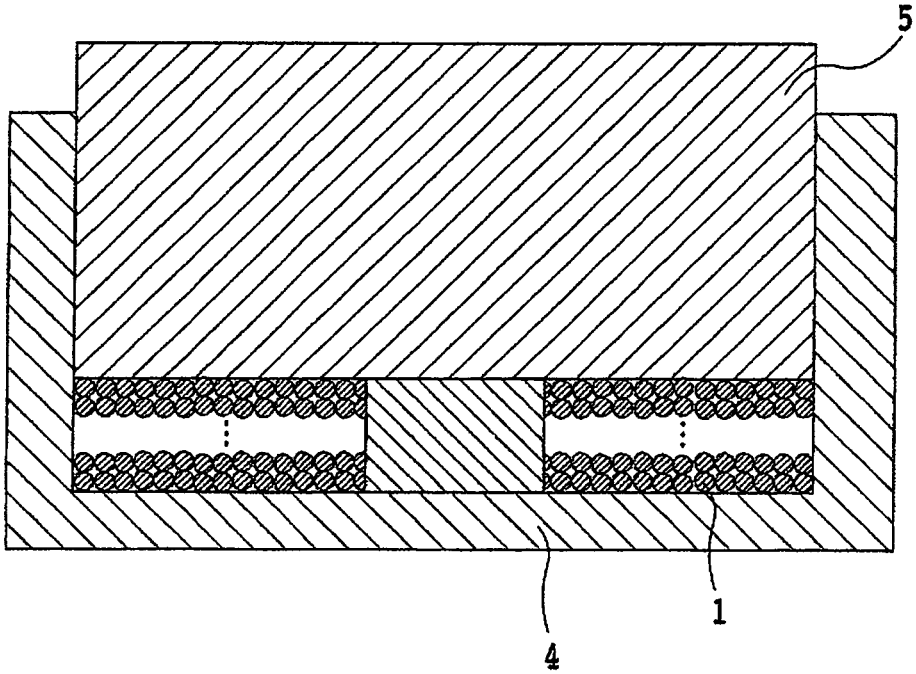
FIG. 4 is a cross sectional view schematically showing the mold assembly molding a magnetic first layer using soft magnetic metal particles, each covered with an insulator oxide coating film formed thereon.
Figure 5:
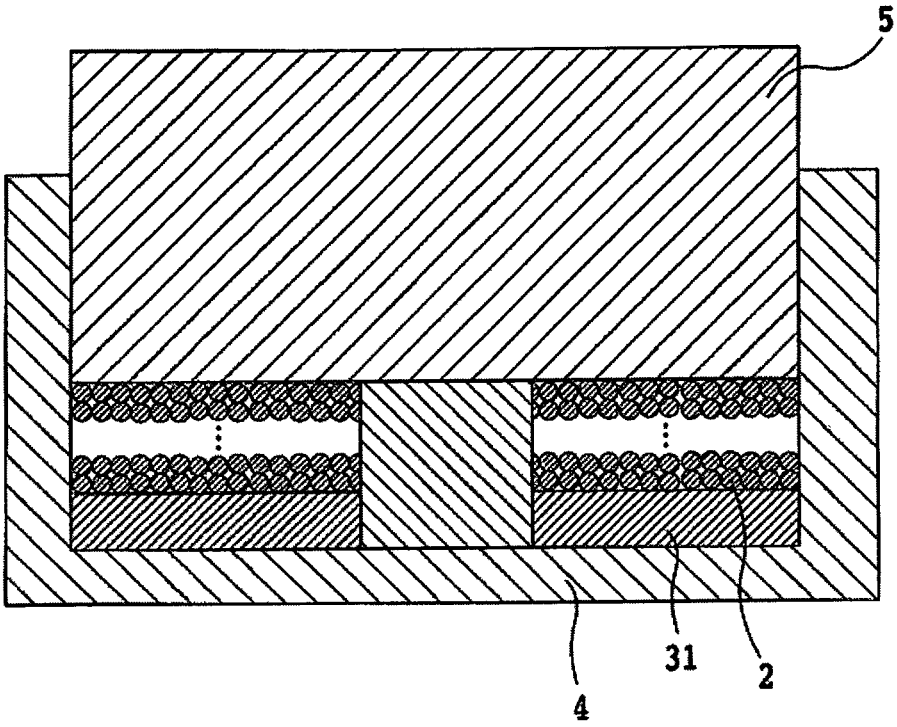
FIG. 5 is a cross sectional view schematically showing the mold assembly molding an insulator first layer on the magnetic first layer using soft magnetic metal particles, each covered with a thick insulator oxide coating film formed thereon.

FIGS. 4 through 6 describe the steps for forming the laminate structure according to the invention. The laminate structure is formed through the step (a) of forming a magnetic layer, the step (b) of forming an insulator layer and repeating the steps (a) and (b) alternately until a designed laminate thickness is obtained. FIG. 4 schematically shows press molding for forming a magnetic first layer using particle 1. FIG. 5 schematically shows press molding for forming an insulator first layer using particles 2, each covered with thick insulator coating 22, on magnetic first layer 31 formed as shown in FIG. 4. FIG. 6 schematically shows press molding for forming a magnetic second layer using particle 1 on insulator first layer 32 formed as shown in FIG. 5. FIG. 3 is a cross-sectional view of a laminated ring core schematically showing the laminate structure thereof including insulator layer 32 and magnetic layer 31 and obtained by repeating the steps described in FIGS. 4 and 5 alternately.

The thickness of the magnetic layer and the thickness of the insulator layer in every manufacturing step are selected appropriately depending on the powder magnetic core size and the purpose of use. It is preferable for the magnetic layer to be 0.05 to 0.3 mm in thickness. A magnetic layer set to be 0.05 mm or more in thickness is preferable to prevent the magnetic permeability lowering caused by the reduced ratio of the magnetic layers from occurring. Even when the magnetic layer is thicker than 0.05 mm, the electrical resistance thereof is high and the eddy current loss is not influential, since the magnetic layer is a compact formed by press molding the metal magnetic particles, each covered with an insulator oxide film. The magnetic layer is preferably 0.3 mm or less in thickness for simultaneously securing a high magnetic permeability and a cutoff frequency of 10 MHz or higher. The magnetic layer thickness described above is half the electronic parts thickness described earlier and the maximum thickness for forming a laminate structure. It is necessary to appropriately adjust the magnetic layer thickness considering the magnetic permeability, the frequency band and such properties.

Preferably, the insulator layer is 1 to 100 μm in thickness. More preferably, the insulator layer is 10 to 100 μm in thickness. For eliminating the electrical coupling and the magnetic coupling between the magnetic layers, it is necessary for the insulator layer to be 1 μm or more in thickness and preferably 10 μm or more in thickness. By setting the insulator layer at 100 μm or less in thickness, it is possible to thin the laminate for the powder magnetic core while securing sufficient inductance. Each layer thickness is adjusted by adjusting the loading amount of particles 1 or particles 2. The press molding is conducted under the uniaxial pressure of 98 to 1960 MPa.

After press molding for forming a green compact having a desired laminate structure, it is preferable to thermally treat the obtained green compact. The heat treatment temperature is conducted at preferably 500 to 900° C. and the heat treatment time is preferably 30 to 120 min. The heat treatment may be conducted in an inert gas atmosphere or in the air. The heat treatment may be conducted in an atmosphere furnace or in an electric furnace.

Now the invention will be described in detail hereinafter in connection with the embodiment and the comparative example thereof.

First Embodiment

A Ni78Mo5Fe particle, 8 μm in average particle diameter and prepared by water atomization, is used for first soft magnetic particle 11. First soft magnetic particles 11 are added to an aqueous water glass solution (alkaline) prepared by dissolving water glass having a composition of $Na_2O{\cdot}SiO_2{\cdot}nH_2O$ (x=2 to 4). Hydrochloric aid is added to the aqueous water glass solution to control the pH thereof. The water glass is hydrolyzed by controlling the pH and silicic acid gel ($H_2SiO_3$) is precipitated onto first soft magnetic particles 11. An $SiO_2$ coating film is formed on first soft magnetic particle 11 by drying the silicic acid gel adhered onto first soft magnetic metal particle 11. It is possible to control the $SiO_2$ coating film thickness by adjusting the concentration of the aqueous water glass solution. The $SiO_2$ coating film is controlled at 20 nm in thickness. The soft magnetic metal particle with an insulator oxide film formed thereon is used as particle 1 for forming a magnetic layer.

Second soft magnetic particle 21 covered with thick insulator coating 22 is used for particle 2. Thick insulator coating 22 for particle 2 is thicker than the first insulator coating 12 for particle 1. A Ni78Mo5Fe particle, 8 μm in average particle diameter and prepared by water atomization, is used for second soft magnetic particle 21. Particle 2 including second soft magnetic particle 21 covered with thick insulator coating 22 is formed in the same manner as particle 1 except that the aqueous water glass solution is controlled at the concentration suited for adjusting the $SiO_2$ coating film thickness on second soft magnetic particle 21 at 200 nm.

The steps described in FIGS. 4 through 6 are conducted to form laminated ring core 3 using particles 1 and 2 obtained as described above. First, magnetic first layer 31 is formed using particles 1. Then, insulator first layer 32 is formed on magnetic first layer 31 using particles 2. Then, magnetic second layer 31 is formed on insulator first layer 32 using particles 1. Then, insulator second layer 32 is formed on magnetic second layer 31 using particles 2. Further, magnetic third layer 31 is formed on insulator second layer 32 using particles 1. In detail, an appropriate amount of particle 1 is loaded in die 4 made of a hard metal. Loaded particles 1 are flattened so that particles 1 may lie uniformly in die 4. Then, cope 5 is inserted into die 4. Then, particles 1 are subjected to uniaxial press molding under a pressure of 196 MPa (2 t/cm$^2$). Then, cope 5 is detached from die 4.

Then, an appropriate amount of particle 2 is loaded in die 4. Loaded particles 2 are flattened so that particles 2 may lie uniformly in die 4. Then, cope 5 is inserted again into die 4. Then, particles 2 are subjected to uniaxial press molding under a pressure of 196 MPa (2 t/cm$^2$). Then, cope 5 is detached from die 4.

The steps described above are repeated alternately. For forming the final layer, particles 1 are loaded in die 4. Particles 1 are subjected to uniaxial press molding under the a pressure of 1177 MPa (12 t/cm$^2$). Thus, laminated ring core 3 shown in FIG. 3 is fabricated. The inner diameter of the obtained ring core is Φ3 mm and the outer diameter thereof is Φ8 mm. Magnetic layer 31 is adjusted to be 0.15 mm in thickness and insulator layer 32 is adjusted to be 0.025 mm in thickness. Laminated ring core 3 is adjusted to be 0.5 mm in height.

The laminated ring core obtained as described above is treated thermally in a nitrogen atmosphere in an atmosphere furnace at 500° C. for 1 hr.

A primary winding is wound 5 turns around the ring core 5 obtained and a secondary winding is wound 5 turns around ring core 5. A complex magnetic permeability $\mu=\mu'+i\mu''$ is measured with a B-H analyzer in the frequency range between 10 kHz and 10 MHz.

The frequency dependence of μ' and the frequency dependence of the μ" are described for the ring core according to the first embodiment in FIG. 7. The loss tan δ at 2 MHz for the ring core according to the first embodiment is listed in Table 1.

Comparative Example

A not-laminated ring core according to a comparative example 1 (hereinafter referred to as a "comparative ring core") is molded by pressing only particles 1 uniaxially under the pressure of 1177 MPa (12 t/cm$^2$) such that the comparative ring core is 0.5 mm in height. The as-molded comparative ring core is treated thermally under the same conditions under which the as-molded ring core according to the first embodiment is treated thermally. The inner diameter and outer diameter of the comparative ring core are the same with those of the ring core according to the first embodiment.

A primary winding is wound 5 turns around the comparative ring core and a secondary winding is wound 5 turns around the comparative ring core. The complex magnetic permeability $\mu=\mu'+i\mu''$ of the comparative ring core is measured with a B-H analyzer in the frequency range between 10 kHz and 10 MHz.

The frequency dependence of μ' and the frequency dependence of the μ" are described for the comparative ring core also in FIG. 7. The loss tan δ at 2 MHz for the comparative ring core is listed in Table 1.

TABLE 1

| | tan δ at 2 MHz |
|---|---|
| First embodiment | 0.011 |
| Comparative example 1 | 0.064 |

As FIG. 7 indicates, the magnetic permeability μ' is 120 according to the comparative example 1. The magnetic permeability μ" according to the comparative example 1 increases monotonically in the frequency range higher than 1 MHz. The magnetic permeability μ' according to the first embodiment is 112 which is lower than the magnetic permeability μ' according to the comparative example 1. The magnetic permeability μ' according to the first embodiment is lowered by the increment of the insulator coating film thickness due to the effect of particle 2 covered with thick insulator coating 22 and used in insulator layer 32. The high frequency properties of the ring core according to the first embodiment is improved around 10 times such that the magnetic permeability μ" according to the first embodiment rises but little in the high frequency range.

As Table 1 indicates, tan δ, which indicates the loss, caused in the ring core according to the first embodiment is reduced to be about one-sixth time as high as the tan δ caused in the ring core according to the comparative example 1.

As described above, the powder magnetic core according to the invention exhibits an excellent magnetic permeability in the high frequency range and facilitates reducing the eddy current loss. Therefore, the powder magnetic core according to the invention, used in the transformer for a switching power supply, reactor and such magnetic component parts, facilitates reducing the volumes of the transformer, reactor and such magnetic component parts and thinning the transformer, reactor and such magnetic component parts.

While the present invention has been described in conjunction with embodiments and variations thereof, one of ordinary skill, after reviewing the foregoing specification, will be able to effect various changes, substitutions of equivalents and other alterations without departing from the broad concepts disclosed herein. It is therefore intended that Letters Patent granted hereon be limited only by the definition contained in the appended claims and equivalents thereof.

What is claimed is:

1. A method of manufacturing a powder magnetic core, the method comprising the steps of:

(a) providing coated soft magnetic particles, all of which are particles of soft magnetic material which each have been coated with a first insulating coating;

(b) providing insulator particles, all of which are particles of soft magnetic material which each have been coated with a second insulating coating having a thickness which is greater than the first insulating coating;

(c) forming a magnetic layer by press molding the coated soft magnetic particles in a mold assembly;

(d) forming an insulator layer on the magnetic layer by press molding the insulator particles in the mold assembly; and (e) repeating the steps (c) and (d) to fabricate a laminate of alternating magnetic layers and insulator layers and provide the powder magnetic core.

2. The method according to claim 1, wherein the coated soft magnetic particles comprise a metal selected from the group consisting of iron, cobalt and nickel.

3. The method according to claim 1, wherein the coated soft magnetic particles comprise an alloy selected from the group consisting of Permalloy, Sendust and alloys of iron, cobalt and nickel.

4. The method according to claim 1, wherein the coated soft magnetic particles have a diameter in a range from 1 to 30 μm.

5. The method according to claim 1, wherein the first insulating coating comprises a material selected from the group consisting of Ferrite, iron-based oxide, glass, silica and alumina.

6. The method according to claim 5, wherein the Ferrite comprises a Ferrite selected from the group consisting of Ni—Zn ferrite and Cu—Zn—Mg ferrite.

7. The method according to claim 5, wherein the glass comprises an oxide selected from the group consisting of $SiO_2$, $B_2O_3$ and $P_2O_5$.

8. The method according to claim 1, wherein the first insulating coating has a thickness in a range from 5 to 50 nm.

9. The method according to claim 1, wherein the second insulating coating comprises a material selected from the group consisting of Ferrite, an iron-based oxide, glass, silica and alumina.

10. The method according to claim 9, wherein the Ferrite comprises a Ferrite selected from the group consisting of Ni—Zn ferrite and Cu—Zn—Mg ferrite.

11. The method according to claim 9, wherein the glass comprises an oxide selected from the group consisting of $SiO_2$, $B_2O_3$ and $P_2O_5$.

12. The method according to claim 1, wherein the second insulating coating has a thickness in a range from 100 to 300 nm.

13. The method according to claim 8, wherein the first insulating coating has a thickness in a range from 10 to 30 nm.

* * * * *